US010533555B2

(12) United States Patent
Iijima et al.

(10) Patent No.: US 10,533,555 B2
(45) Date of Patent: Jan. 14, 2020

(54) SCROLL COMPRESSOR

(71) Applicant: HITACHI-JOHNSON CONTROLS AIR CONDITIONING, INC., Tokyo (JP)

(72) Inventors: Ryota Iijima, Tokyo (JP); Kazumi Tamura, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 16/088,931

(22) PCT Filed: Nov. 6, 2017

(86) PCT No.: PCT/JP2017/039892
§ 371 (c)(1),
(2) Date: Sep. 27, 2018

(87) PCT Pub. No.: WO2018/092622
PCT Pub. Date: May 24, 2018

(65) Prior Publication Data

US 2019/0128266 A1 May 2, 2019

(30) Foreign Application Priority Data

Nov. 21, 2016 (JP) ..... 2016-226286

(51) Int. Cl.
*F04C 29/12* (2006.01)
*F04C 29/00* (2006.01)
*F04C 18/02* (2006.01)

(52) U.S. Cl.
CPC ..... *F04C 29/12* (2013.01); *F04C 18/0223* (2013.01); *F04C 29/0085* (2013.01)

(58) Field of Classification Search
CPC ... F04C 18/0215; F04C 18/0223; F04C 28/26
See application file for complete search history.

(56) References Cited

U.S. PATENT DOCUMENTS 5,037,278 A * 8/1991 Fujio ..... F04C 18/0215 418/181
6,273,691 B1 * 8/2001 Morimoto ..... F04C 28/26 418/15

(Continued)

FOREIGN PATENT DOCUMENTS

CN 102483060 A 5/2012
CN 102650289 A 8/2012

(Continued)

OTHER PUBLICATIONS

Chinese Office Action received in corresponding Chinese Application No. 201780020318.8 dated Mar. 8, 2019.

(Continued)

*Primary Examiner* — Patrick Hamo
(74) *Attorney, Agent, or Firm* — Mattingly & Malur, PC

(57) ABSTRACT

A scroll compressor has: a revolving scroll; a fixed scroll; a compression chamber that is defined by the revolving scroll and the fixed scroll to compress a working fluid; a suction chamber that is defined by the revolving scroll and the fixed scroll to suck the compressed working fluid; an electric motor that drives the revolving scroll; a bypass mechanism that communicates or shuts off between the compression chamber and the suction chamber; and a sealed vessel, wherein the bypass mechanism has: a bypass port that is formed in the fixed scroll and communicates between the compression chamber and the suction chamber; and a bypass valve that opens and closes the bypass port, and wherein a groove is formed in the revolving lap to communicate between the bypass port and a suction pressure space when the bypass port is open.

6 Claims, 13 Drawing Sheets

(56) References Cited

U.S. PATENT DOCUMENTS

| | | | | |
|---|---|---|---|---|
| 2002/0081224 | A1* | 6/2002 | Ueda | F04C 28/22 418/55.5 |
| 2007/0201997 | A1* | 8/2007 | Hiwata | F04C 18/0215 418/55.6 |
| 2014/0010693 | A1 | 1/2014 | Imada et al. | |

FOREIGN PATENT DOCUMENTS

| | | | | |
|---|---|---|---|---|
| CN | 103384769 | A | 11/2013 | |
| CN | 103423157 | A | 12/2013 | |
| EP | 2679823 | A1 | 1/2014 | |
| JP | 2007-154762 | A | 6/2007 | |
| JP | 2016-145522 | A | 8/2016 | |
| WO | 2012/114455 | A1 | 8/2012 | |
| WO | WO-2012114455 | A1 * | 8/2012 | F04C 18/0215 |

OTHER PUBLICATIONS

International Search Report of PCT/JP2017/039892 dated Jan. 23, 2018.

* cited by examiner

SCROLL COMPRESSOR

TECHNICAL FIELD

The present invention relates to a scroll compressor.

BACKGROUND ART

A scroll compressor has been known as a refrigerant compressor used in a refrigeration cycle such as for refrigeration or air-conditioning, or a gas compressor that compresses air or other gases. Further, a compressor having a volume control mechanism has been known to achieve high efficiency over a wide load range. For example, one of volume control methods frequently used for controlling the volume of the compressor is such that a frequency of a motor current in the compressor is changed with an inverter to electrically control a rotational speed.

However, if the rotational speed is extremely reduced, a leakage of the refrigerant in a compression chamber may be increased and motor efficiency may be decreased, to substantially reduce compressor efficiency. Further, in an extremely low speed region of the rotational speed, an oil film at a bearing is not retained due to oil viscosity, to cause bearing elements to directly contact a shaft, leading to burning or the like. To prevent these problems, a lower limit value is set for a practical rotational speed and a lower limit is also set for a volume control range.

To extend the volume control range more than the lower limit of the rotational speed control, some control methods for controlling an amount of a refrigerant have been considered, in which compression is operated by mechanically bypassing a part of the refrigerant from the refrigeration cycle.

For example, Patent Document 1 discloses "a scroll compressor comprising a compression mechanism in a casing, in which at least one of a first scroll member and a second scroll member, each having on its end plate a spiral lap to engage with each other, eccentrically rotates and a compression chamber is defined by the engaged laps between the inner surfaces of the end plates; and an operation volume control mechanism having an opening that is formed in the end plate of the first scroll member and communicates with the compression chambers, and a piston that opens and closes the opening, wherein the piston is formed based on a dimension tolerance with which a top surface protrudes more than an inner surface of the end plate of the first scroll member in a state of closing the opening, and, at least a top portion of the piston, which protrudes more than the inner surface of the end plate of the first scroll member in the state of closing the opening, is formed of a material having an abrasion resistance lower than that of the laps" (see Claim 1).

In the structure above, the bypass valve (piston) is opened at the time of volume control, to communicate between the compression chambers and a suction side of the compressor via a bypass port of the opening. This bypasses the refrigerant without being compressed and delays a compression timing, to reduce a discharge flow amount of the compressed refrigerant for controlling the volume.

PRIOR ART DOCUMENTS

Patent Documents

Patent Document 1: Japanese Patent Application Publication No. 2007-154762

SUMMARY OF THE INVENTION

Problem to be Solved by the Invention

However, in the scroll compressor disclosed in Patent Document 1, in a section where the lap of the second scroll member is in contact with the lap of the first scroll member at the position of the bypass port, the lap of the second scroll member positions at an end of the opening before the compression starts, to stop the communication between the compression chambers and the suction side. The refrigerant in the compression chambers is compressed during the time.

Accordingly, unnecessary compression power is generated before the compression starts and a loss due to excessive compression (see FIG. 13) occurs, to decrease efficiency. FIG. 13 shows a relationship between rotational angles of a conventional second scroll member and pressure in the compression chambers defined by the first scroll member and the second scroll member.

The present invention has been made in view of the above circumstances, and provides a scroll compressor that reduces a loss and has high efficiency over a wide operation range.

Solution to Problem

To solve the problem above, the present invention provides a scroll compressor including: a revolving scroll having a revolving lap; a fixed scroll having a fixed lap; a compression chamber that is a closed space defined by the revolving scroll and the fixed scroll to compress a working fluid; a suction chamber that is an open space defined by the revolving scroll and the fixed scroll to suck the compressed working fluid; an electric motor that drives the revolving scroll; a bypass mechanism that communicates or shuts off between the compression chamber and the suction chamber; and a sealed vessel that accommodates the revolving scroll, the fixed scroll, the compression chamber, the suction chamber, the electric motor and the bypass mechanism, wherein the bypass mechanism has: a bypass port that is formed in the fixed scroll and is capable of communicating between the compression chamber and the suction chamber; and a bypass valve that is capable of opening and closing the bypass port, and wherein a groove is formed in the revolving lap to communicate between the bypass port and a suction pressure space when the bypass port is open and the groove has a bottom surface, which is inclined outward and upward, at an end closer to a winding end of the revolving lap of the revolving scroll.

Advantageous Effects of the Invention

According to the present invention, a scroll compressor is provided that reduces a loss and has high efficiency over a wide operation range.

DETAILED DESCRIPTION OF THE PREFERRED EMBODIMENTS

Figure 1:
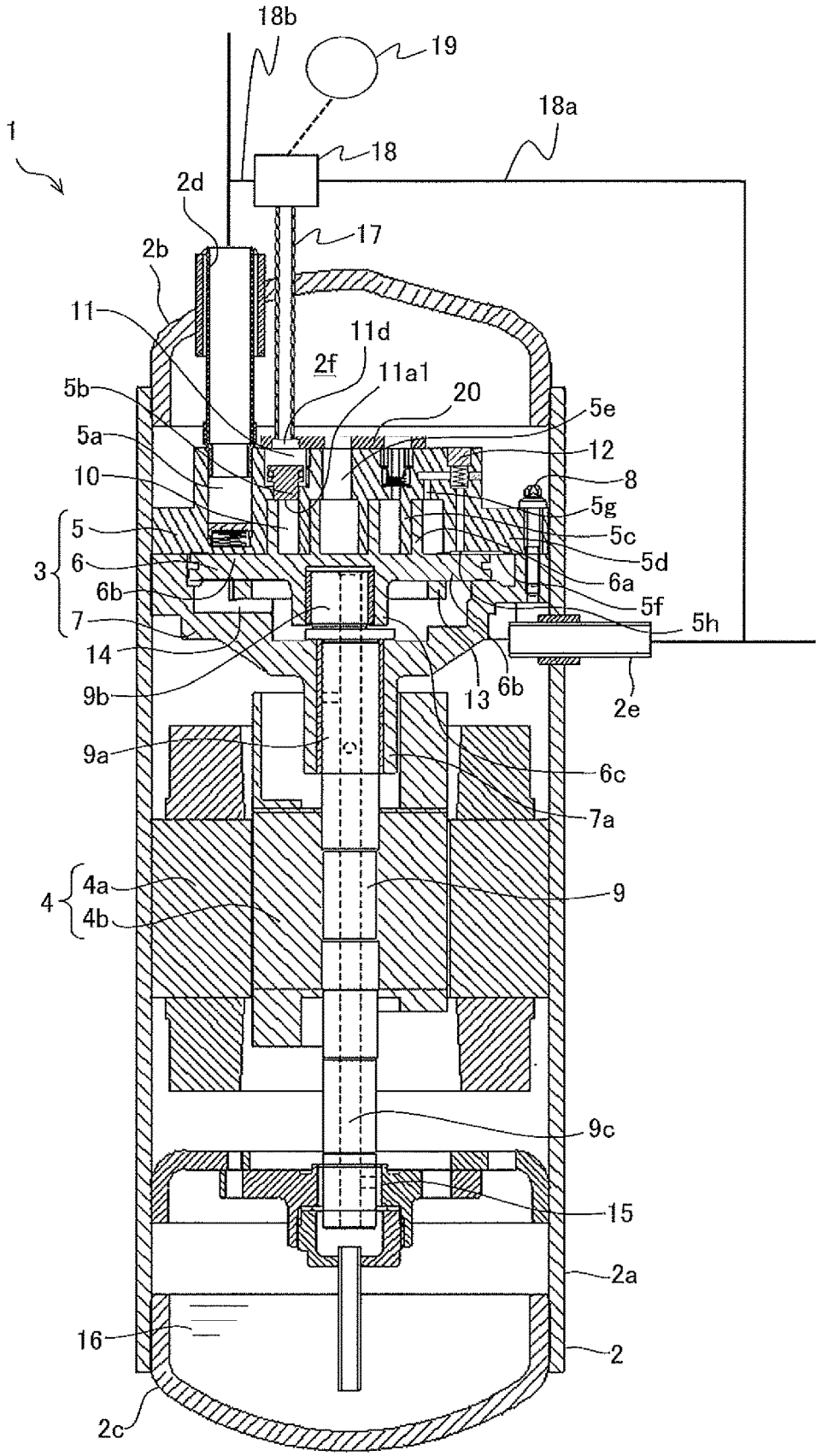
FIG. 1 is a vertical cross-sectional view of a compressor according to a first embodiment of the present invention.

A description will be given in detail of an embodiment of the present invention with reference to the drawings as appropriate. Note that, in the drawings below, the same members are denoted with the same reference numerals, and duplicate descriptions are omitted.

<First Embodiment>

FIGS. 1 to 5 show a structure of a compressor 1 according to a first embodiment.

FIG. 1 is a vertical cross-sectional view of the compressor 1 according to the first embodiment of the present invention.

Figure 2:
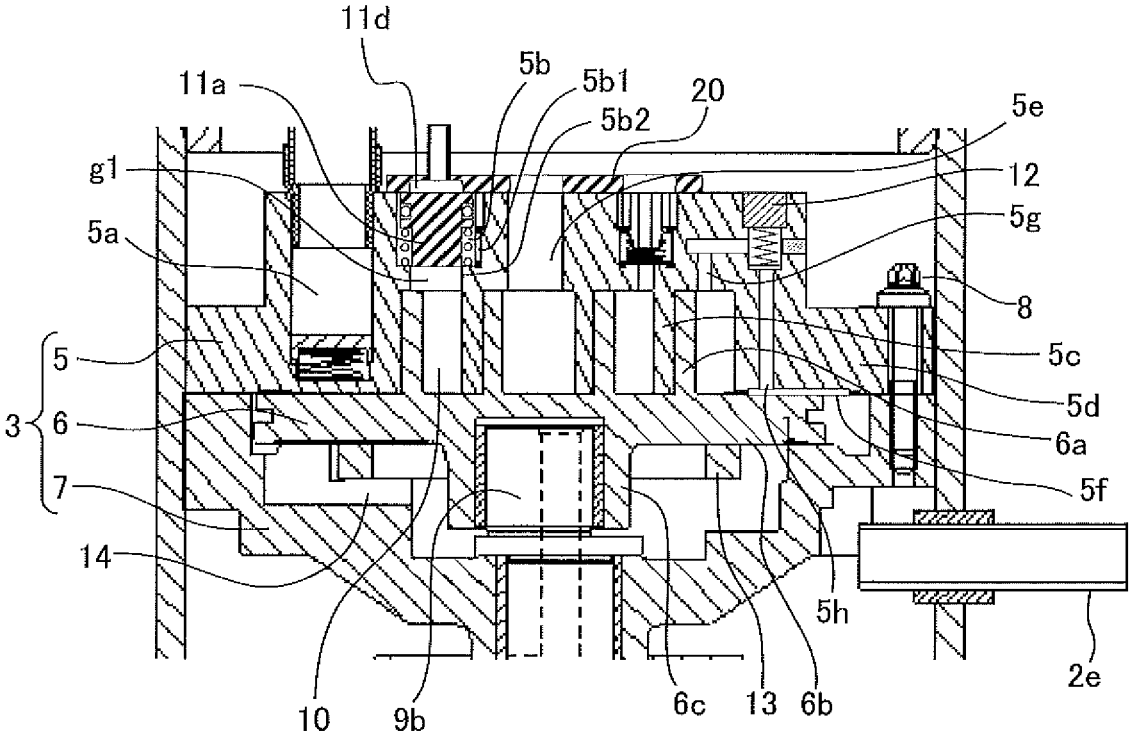
FIG. 2 is a vertical cross-sectional view of an enlarged compression mechanical section of the compressor shown in FIG. 1.

FIG. 2 is an enlarged vertical cross-sectional view of a compression mechanical section 3 of the compressor 1 in FIG. 1.

The compressor 1 according to the first embodiment is a scroll compressor.

The compressor 1 controls a volume by switching between a full load operation in which a gas refrigerant (working fluid) supplied from a suction port 5*a* is compressed in the compression mechanical section 3 and a partial load operation in which a part of the gas refrigerant is compressed.

In the partial load operation, the part of the gas refrigerant is bypassed to a suction side and the remaining gas refrigerant is compressed in a compression chamber 10.

The compressor 1 has the compression mechanical section 3 for compressing the gas refrigerant (hereinafter, referred to as refrigerant), an electric motor 4 as drive source of the compression mechanical section 3, a sealed vessel 2 for accommodating the compression mechanical section 3, the electric motor 4 and the like, and a control unit (18, 19).

Figure 3:
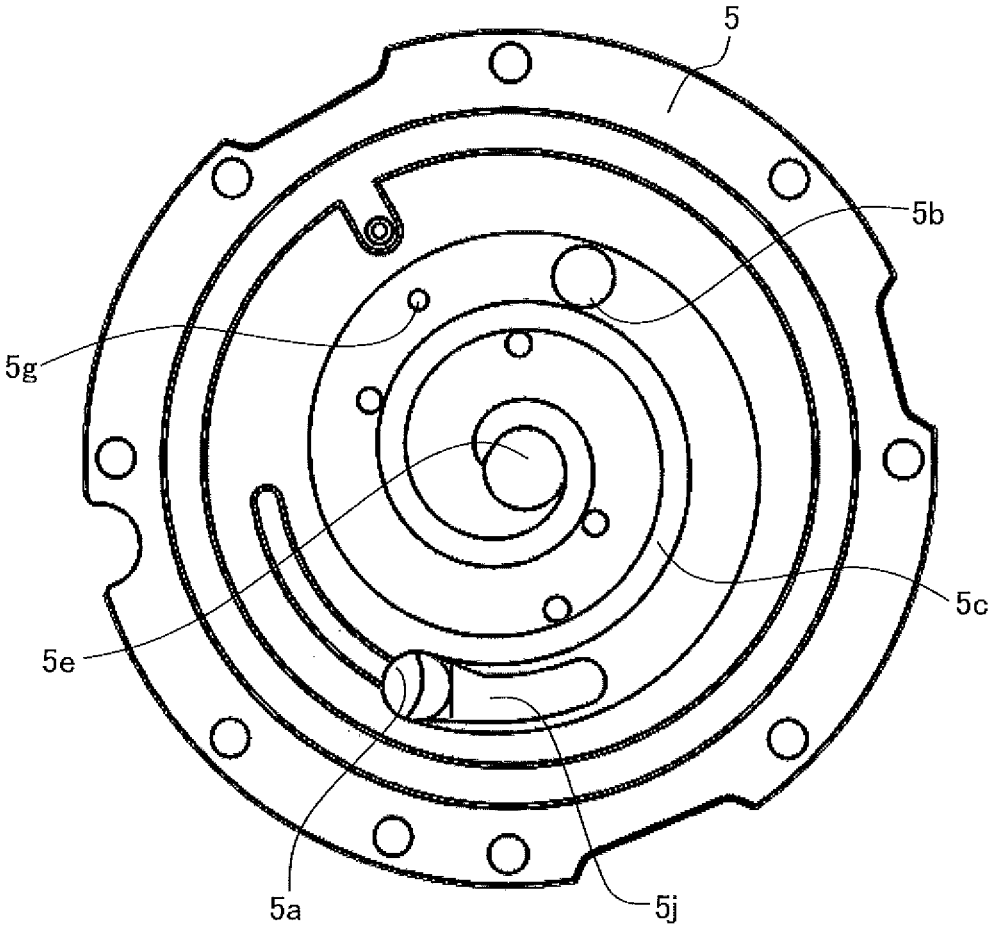
FIG. 3 is a bottom view of a fixed scroll of the compressor according to the first embodiment.
Figure 4:
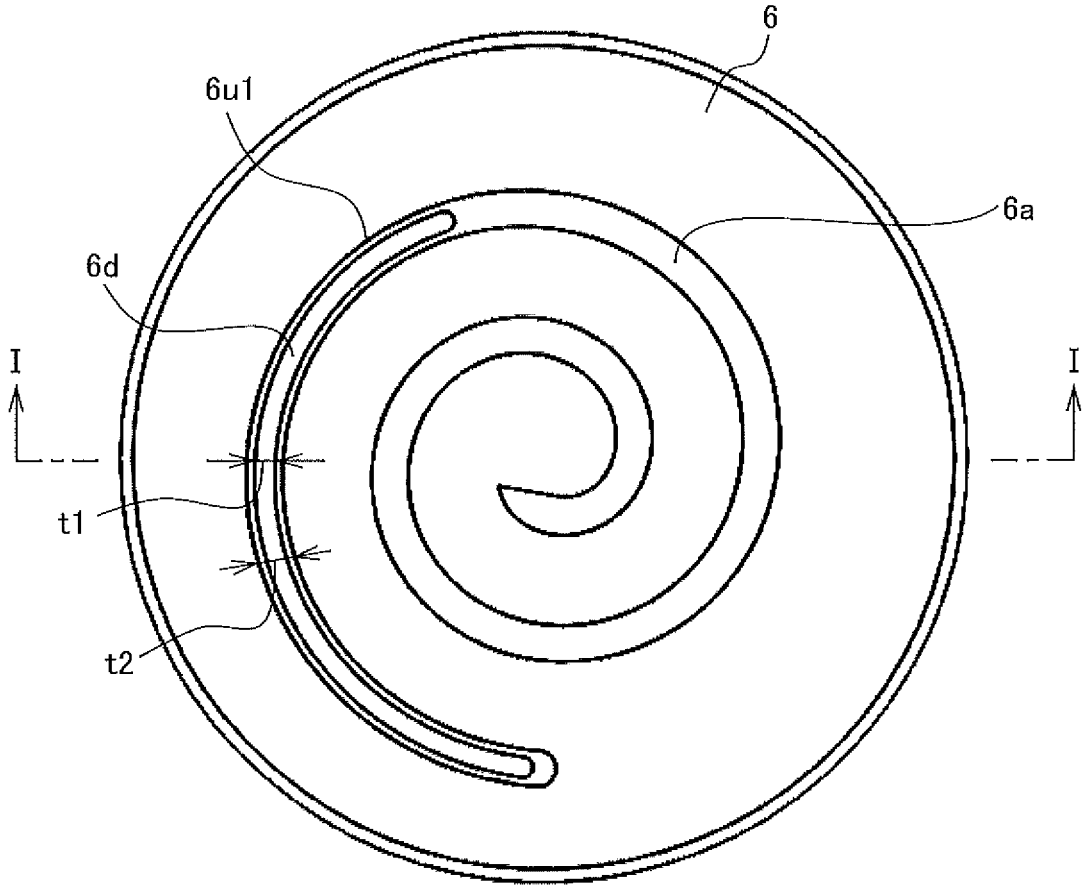
FIG. 4 is a top view of a revolving scroll of the compressor according to the first embodiment.
Figure 5:
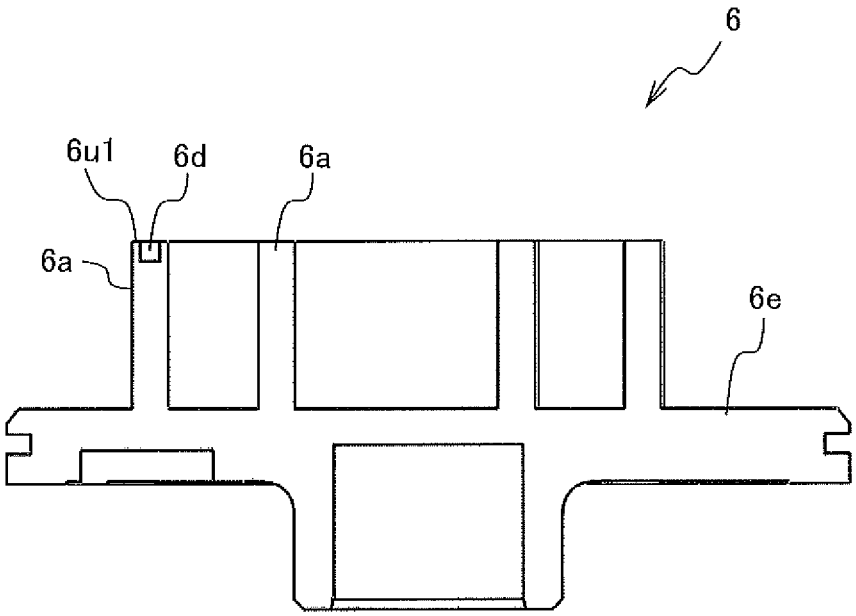
FIG. 5 is a cross-sectional view taken along a line I-I in FIG. 4.

FIG. 3 is a bottom view of a fixed scroll 5 of the compressor 1 according to the first embodiment. FIG. 4 is a top view of a revolving scroll 6 of the compressor 1 according to the first embodiment. FIG. 5 is a cross-sectional view taken along an I-I line in FIG. 4.

The compression mechanical section 3 has the fixed scroll 5 having a spiral lap 5*c* which is vertically arranged at a lower portion and the revolving scroll 6 having a spiral lap 6*a* which is vertically arranged at an upper portion. The revolving scroll 6 is arranged under the fixed scroll 5.

The sealed vessel 2 has a case 2*a* in a cylindrical shape that is vertically arranged in the middle, a lid chamber 2*b* at the top and a bottom chamber 2*c* at the bottom that are welded to the case 2*a*.

The compression mechanical section 3 is arranged in an upper part of the sealed vessel 2, and the electric motor 4 is arranged at a lower part via a crankshaft 9. A lubricant 16 is accumulated in the bottom of the sealed vessel 2. The lubricant 16 is supplied to the mechanical section via an oil supply passage 9*c* of the crankshaft 9.

A suction pipe 2*d* to suck the refrigerant to be compressed is arranged through the lid chamber 2*b* at the top. As shown in FIG. 1, a suction port 5*a* connected to the suction pipe 2*d* is formed in the fixed scroll 5. The suction port 5*a* is used to suck the refrigerant to be compressed, and is arranged coaxially with the suction pipe 2*d*.

A discharge port 5*e* that communicates between the compression chamber 10 and the other side (upper side) of the fixed scroll 5 from the lap is defined approximately at the center of a base plate 5*d* of the fixed scroll 5. The discharge port 5*e* is used to discharge the refrigerant compressed in the compression mechanical section 3.

The sealed vessel 2 defines therein a discharge pressure chamber 2*f* from which the refrigerant compressed in the compression mechanical section 3 is discharged. A discharge pipe 2*e* through which the compressed refrigerant is discharged is arranged through a side surface of the centrally located case 2*a*.

<Compression Mechanical Section 3>

The compression mechanical section 3 has the fixed scroll 5 in the upper part, the revolving scroll 6 under the fixed scroll 5, and a frame 7 that supports the revolving scroll 6 from below.

As shown in FIG. 2, the fixed scroll 5 has the spiral lap 5*c* extending downward toward an end plate 5*f* of the base plate 5*d* as a main body.

The revolving scroll 6 has, as with the fixed scroll 5, the spiral lap 6*a* extending upward on a base plate 6*b* as a main body.

The frame 7 is integrally fixed to the fixed scroll 5 by a bolt 8, and slidably supports the revolving scroll 6 from below.

The spiral lap 5*c* of the fixed scroll 5 is engaged with the spiral lap 6*a* of the revolving scroll 6 to define the compression chamber 10 so as to compress the refrigerant. The compression chamber 10 is a closed space between the fixed scroll 5 and the revolving scroll 6. Further, the spiral lap 5*c* of the fixed scroll 5 is engaged with the spiral lap 6*a* of the revolving scroll 6 to define a suction chamber 10*a* (see FIG. 7A). The suction chamber 10*a* is defined by the fixed scroll 5 and the revolving scroll 6, and serves as a communication space with the suction port 5*a*.

<Bypass Port 5*b*>

As shown in FIG. 2, a bypass port 5*b* is defined in the base plate 5*d* of the fixed scroll 5 to penetrate from the compression chamber 10 to the other side (upper side) of the fixed scroll 5. The bypass port 5*b* is used for volume control, to be fully closed at the time of full load operation and to be opened at the time of partial load operation. That is, at the time of full load operation, a bypass valve 11 fills in a gap g1 of the bypass port 5*b* to close a communication between the compression chamber 10 and the suction chamber 10*a*, and, at the time of partial load operation, the compression chamber 10 is communicated with the suction chamber 10*a* via the gap g1 of the bypass port 5*b* (see FIG. 2).

Thus, the amount of refrigerant to be compressed is adjusted to control an output of the compressor 1.

The bypass port 5*b* is formed, for example, with two coaxial cylindrical grooves, each having a different diameter, in communication with each other. As shown in FIG. 2, the bypass port 5*b* has a cylindrical groove 5*b*1 on the other (upper) side from the lap and a cylindrical groove 5*b*2 on the lower lap 6*c* side, the former having a larger diameter than the latter.

The diameter of the cylindrical groove 5*b*2 on the lower lap side of the bypass port 5*b* only needs to be larger than a thickness t2 of the lap 6*a* of the revolving scroll 6. That is, an opening of the cylindrical groove 5*b*2 on the lap side only needs to be defined over the lap 6*a* of the revolving scroll 6.

As shown in FIG. 4, the revolving scroll 6 has a tooth-top groove 6*d* in an concave shape partially arranged along a spiral shape of the lap 6*a* in the center of a tooth top of the spiral lap 6*a* facing the fixed scroll 5.

Figure 6:
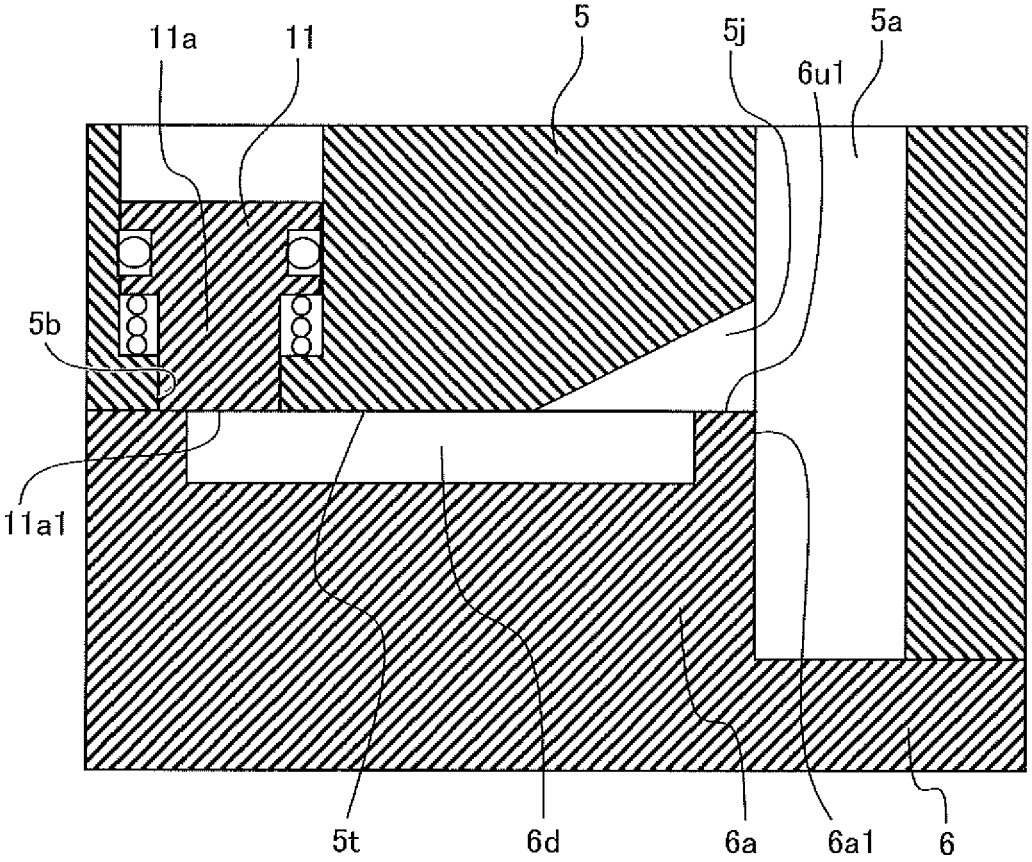
FIG. 6 is a vertical cross-sectional view of the fixed scroll and the revolving scroll along a center line of a tooth-top groove.

The tooth-top groove 6*d* has a width t1 narrower than the thickness t2 of the lap 6*a*, and, one end thereof is a winding start of the lap 6*a* and is formed at a position to communicate with the bypass port 5*b* (see FIGS. 7A to 7D). FIG. 6 is a vertical cross-sectional view of the fixed scroll 5 and the revolving scroll 6 along a center line of the tooth-top groove 6*d*.

The other end of the tooth-top groove 6*d* is a winding end 6*a*1 of the lap 6*a* and is formed at a position to communicate with an inclined groove 5*j* formed on the fixed scroll 5. The inclined groove 5*j* is formed to have a slope extending upward and outward from a tooth-top surface 5*t* of the fixed scroll 5 to the suction port 5*a*. The inclined groove 5*j* allows the tooth-top groove 6*d* to communicate with the suction port 5*a*.

The tooth-top groove 6*d* is formed to always communicate between the bypass port 5*b* and the suction side. The refrigerant flowing into the tooth-top groove 6*d* can be flown to the suction port 5*a* through the inclined groove 5*j*. Further, an advantageous effect can be obtained such that the lubricant 16 flowing into the inclined groove 5*j* is discharged outside.

Note that, though the cross section of the tooth-top groove 6*d* is in a rectangular shape in FIG. 6, the cross-sectional shape is not necessarily in a rectangular shape. For example, the tooth-top groove 6*d* may have a U-shaped cross section or a V-shaped cross section. The shape of the tooth-top groove 6*d* is not limited as long as the groove is in a concave shape. Further, the shape of the inclined groove 5*j* is not limited as long as it communicates between the tooth-top groove 6*d* and the suction port 5*a*.

<Bypass Valve 11>

The bypass valve 11 has a shape in which two coaxial cylinders, each having a different diameter, are connected, so as to be fitted in the bypass port 5*b*. As shown in FIG. 2, the bypass valve 11 is fitted into the bypass port 5*b*, in which a port insert 11*a* at a lower cylindrical portion having a smaller diameter than an upper cylindrical portion is oriented to the lap 5*c* side (lower side) of the fixed scroll 5.

A planar retainer 20 is attached on the other side of the fixed scroll 5 from the lap 5*c*. The retainer 20 prevents the bypass valve 11 from coming off the fixed scroll 5 outside because the bypass valve 11 abuts the retainer 20.

As shown in FIG. 2, at the time of full load operation, the bypass valve 11 does not come off the cylindrical groove 5*b*1 on the other side of the bypass port 5 from the lap even when the bypass valve 11 presses the revolving scroll 6.

Further, at the time of partial load operation, the bypass valve 11 does not come off the cylindrical groove 5*b*1 on the other side of the bypass port 5 from the lap even when the bypass valve 11 is away from the revolving scroll 6.

<Pressure Switching Device 18>

The pressure switching device 18 shown in FIG. 1 is mounted outside the sealed vessel 2, and communicates with a control pressure space 11*d* via a control pipe 17. Further, the pressure switching device 18 has a high pressure side channel 18*a* connected to the discharge pipe 2*e* for discharging the compressed refrigerant and a low pressure side channel 18*b* connected to the suction pipe 2*d* for the refrigerant before the compression.

Thus, the pressure switching device 18 can take the refrigerant under a low suction pressure and the refrigerant under a high discharge pressure, and selectively introduces one of the refrigerants at two pressure levels to the control pipe 17.

The refrigerant pressure introduced in the control pipe 17 is controlled to be switched at an arbitrary timing by the pressure switching device 18 with a signal from the pressure control device 19.

<Each Member>

The crank shaft 9 for revolving the revolving scroll 6 with the electric motor 4 is vertically extended at the center in the sealed vessel 2.

As shown in FIG. 1, the frame 7 fixed to the sealed vessel 2 has a main bearing 7*a* to rotatably support the crankshaft 9. A revolving bearing 6*c* is arranged, at a lower portion of the revolving scroll 6, to be coupled with an eccentric portion 9*b* of the crankshaft 9.

A back pressure chamber 14 is defined between the other side, on the lower side, of the revolving scroll 6 from the lap 6*a* and the frame 7. The revolving scroll 6 is pressed against the fixed scroll 5 from below by the back pressure of the back pressure chamber 14.

An Oldham ring 13 is arranged in the back pressure chamber 14. The Oldham ring 13 serves to cause the revolving scroll 6 to be revolved by receiving eccentric rotation of the eccentric portion 9*b* of the crankshaft 9, without the revolving scroll 6 being rotated.

The Oldham rings 13 are attached in a groove (not shown) formed on the other side (lower side) of the revolving scroll 6 from the lap 6*a* and a groove (not shown) formed on the upper center of the frame 7.

As shown in FIG. 2, in the fixed scroll 5, oil inlet holes 5*g*, 5*h* are formed to communicate between the back pressure chamber 14 and the compression chamber 10. A back pressure control valve 12 is arranged between the oil inlet holes 5*g*, 5*h*.

As shown in FIG. 1, the electric motor 4 has a stator 4*a* and a rotor 4*b*. The stator 4*a* is fixed to the sealed vessel 2 by press fitting, welding or the like. The rotor 4*b* has the crankshaft 9 fixed thereto and is rotatably supported in the stator 4*a*.

The crankshaft 9 includes a main shaft 9*a* and the eccentric portion 9*b*, and is supported by the upper main bearing 7*a* arranged in the frame 7 and a lower bearing 15 arranged in the sealed vessel 2. The eccentric portion 9*b* is formed integrally to be eccentric to the main shaft 9*a* of the crankshaft 9, and is fitted into the revolving bearing 6*c* formed in a lower portion of the revolving scroll 6. This allows the revolving scroll 6 to rotate with respect to the eccentric portion 9*b*.

The crankshaft 9 is rotatively driven by the electric motor 4. Then, the eccentric portion 9*b* of the crankshaft 9 is eccentrically rotates with respect to the main shaft 9*a*, to revolve the revolving scroll 6. Further, the crankshaft 9 has the oil supply passage 9*c* at the center, through which the lubricant 16 flows to the main bearing 7*a* of the frame 7, the lower bearing 15, and the revolving bearing 6*c* of the revolving scroll 6. The lubricant 16 supplied from the oil supply passage 9*c* (see FIG. 1) to the revolving bearing 6*c* flows through the back pressure chamber 14, the oil inlet holes 5*h*, 5*g* to the lap 5*c* of the fixed scroll 5 and the lap 6*a* of the revolving scroll 6 which define the compression chamber 10.

The compressor 1 switches the full load operation and the partial load operation to control the volume. In the full load operation, the bypass valve 11 is closed to compress the refrigerant sucked through the suction port 5*a*. In the partial load operation, the bypass valve 11 is opened to circulate a part of the refrigerant in the compression chamber 10 without being compressed to the suction side through the bypass port 5*b* and to cause the rest of the refrigerant to be compressed.

<Full Load Operation>

An operation of the full load operation with the closed bypass valve 11 will be described with reference to FIGS. 7A to 7D.

FIGS. 7A to 7D are bottom views of the compression chamber 10 and the suction chamber 10*a*, showing a relationship between the compression chamber 10, the bypass port 5*b* and the tooth-top groove 6*d* in the compressor 1 according to the first embodiment.

In the order of 7A, 7B, 7C and 7D, the rotation angle of the revolving scroll 6 increases.

When a refrigerant in high pressure is supplied from the pressure switching device 18 (see FIG. 1) to the control pressure space 11*d* and the bypass valve 11 is closed, the scroll compressor 1 operates in the full load operation. When the bypass valve is closed, the bypass port 5 shuts off the compression chamber 10 from suction chamber 10*a*.

When the revolving scroll 6 is revolved via the eccentric portion 9*b* of the crankshaft 9 driven by the electric motor 4, as shown in FIG. 1, the refrigerant flows from the suction pipe 2*d* through the suction port 5*a* of the fixed scroll 5 to the suction chamber 10*a* (see FIG. 7A) defined by the revolving scroll 6 and the fixed scroll 5. Here, the suction chamber 10*a* is shortly to be a closed space to form the compression chamber 10 (see FIG. 7B). As the refrigerant moves toward the center of the revolving scroll 6 and the fixed scroll 5, it is compressed because the compressor chamber 10 is reduced in volume (see FIGS. 7C, 7D). Note that the compression chamber 10 is formed, as described above, by the spiral lap 5*c* of the fixed scroll 5 and the spiral lap 6*a* of the revolving scroll 6 being engaged with each other.

At this stage, the port insert 11*a* of the bypass valve 11 fully closes the cylindrical groove 5*b*2 of the bypass port 5*b* facing the lap, and further, is brought in contact with an upper surface 6*u*1 (see FIG. 6) of the lap 6*a* of the revolving scroll 6.

As described above, the tooth-top groove 6*d* is formed in the tooth top of the lap 6*a*. As shown in FIGS. 7A to 7D, one end of the tooth-top groove 6*d* is positioned to face the lower portion of the bypass port 5*b*. However, as shown in FIG. 6, a front end surface (lower end surface) 11*a*1 of the port insert 11*a* of the bypass valve 11 is always in contact with the tooth top surface (upper surface 6*u*1 on the tooth top of the lap 6*a*) around the tooth-top groove 6*d*, to close the space between the compression chamber 10 and the tooth-top groove 6*d*. Accordingly, the flow of the refrigerant between the compression chamber 10 and the tooth-top groove 6*d* is shut off.

Accordingly, as shown in FIG. 6, when the bypass valve 11 is closed, in other words, when the port insert 11*a* of the bypass valve 11 presses to contact the upper surface 6*u*1 of the lap 6*a* of the revolving scroll 6, the refrigerant is prevented from leaking from the compression chamber 10 through the tooth-top groove 6*d* toward the suction side.

Further, when the port insert 11*a* of the bypass valve 11 contacts the lap 6*a* of the revolving scroll 6 from above, the compression chamber 10 is also shut off from the suction chamber 10*a*. Therefore, the refrigerant in the compression chamber 10 is compressed immediately after the suction has been completed. Then, the refrigerant compressed in the compression chamber 10 is discharged from the discharge port 5*e* (see FIG. 1) formed approximately at the center of the base plate 5*d* of the fixed scroll 5 to the discharge pressure chamber 2*f*. The refrigerant discharged to the discharge pressure chamber 2*f* flows outside through the discharge pipe 2*e* (see FIG. 1).

As described above, at the time of full load operation, a high efficient operation is executed similar to the compressor 1 without a volume control mechanism.

<Partial Load Operation>

Next, a behavior of the partial load operation with the opened bypass valve 11 will be described with reference to FIGS. 7A to 7D and FIG. 8.

Opening the bypass valve 11 means that the port insert 11*a* of the bypass valve 11 is separated from the upper surface 6*u*1 of the lap 6*a* of the revolving scroll 6, to communicate between the compression chamber 10 and the suction chamber 10*a* via the gap g1 of the bypass valve 11.

Figure 8:
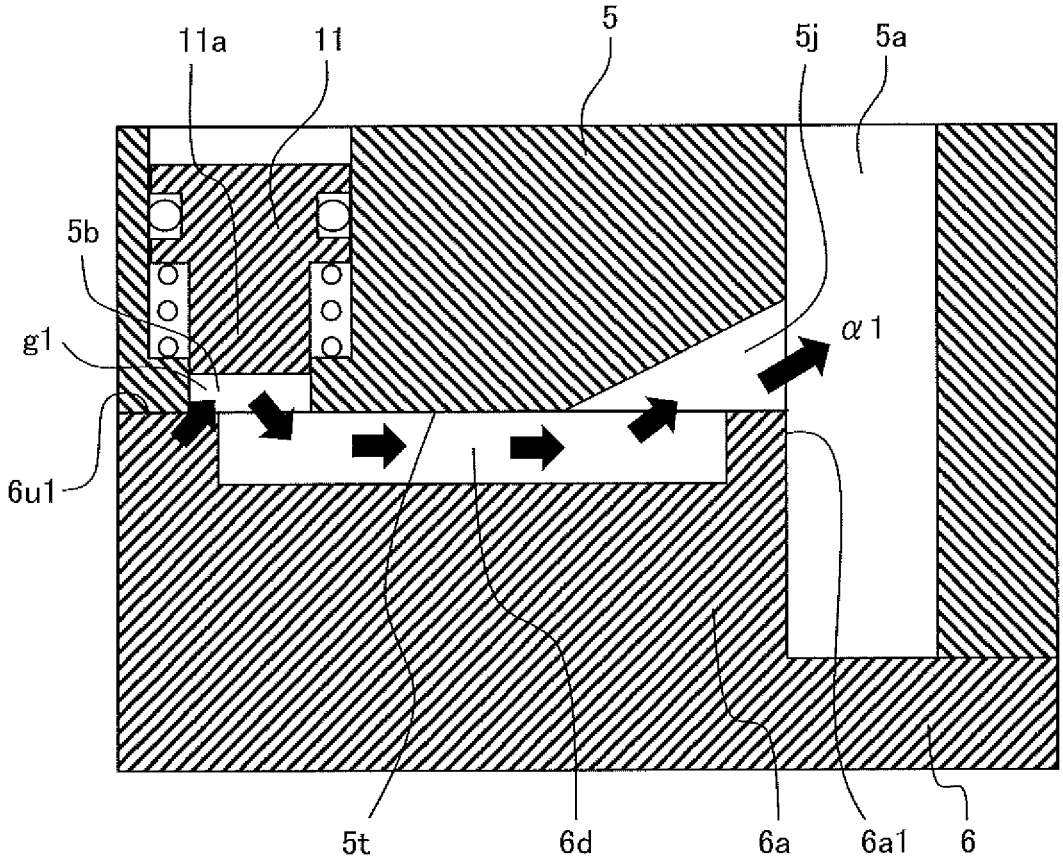
FIG. 8 is a vertical cross-sectional view of the fixed scroll and the revolving scroll along the center line of the tooth-top groove at a time of partial load operation in the compressor according to the first embodiment.

FIG. 8 is a vertical cross-sectional view of the fixed scroll 5 and the revolving scroll 6 taken along a center line of the tooth-top groove 6*d* during the partial load operation in the compressor 1 according to the first embodiment.

When the control pressure space 11*d* communicates with the suction pressure space through the low pressure side channel 18*b* and the pressure switching device 18 shown in FIG. 1, the pressure in the control pressure space 11*d* (see FIG. 2) is equal or less than the pressure in the compression chamber 10 that communicates with the bypass port 5*b*. Therefore, a gas load is not applied to close the bypass valve 11, that is, to move the bypass valve 11 shown in FIG. 1 downward.

Further, when a load (spring force) is applied to move the bypass valve 11 upward on the other side from the lap 6*a* by a spring 11*c*, the bypass valve 11 is separated from the revolving scroll 6 and is pressed upward to contact the retainer 20. Thus, the pressure chamber 10 communicates with the suction chamber 10*a* via the gap g1 of the bypass port 5*b* and the bypass port 5*b* is opened.

In this case, the compressor 1 executes the partial load operation to be described below.

Hereinafter, a description will given of a detailed operation of the partial load operation with reference to FIGS. 7A to 7D.

Figure 7A:
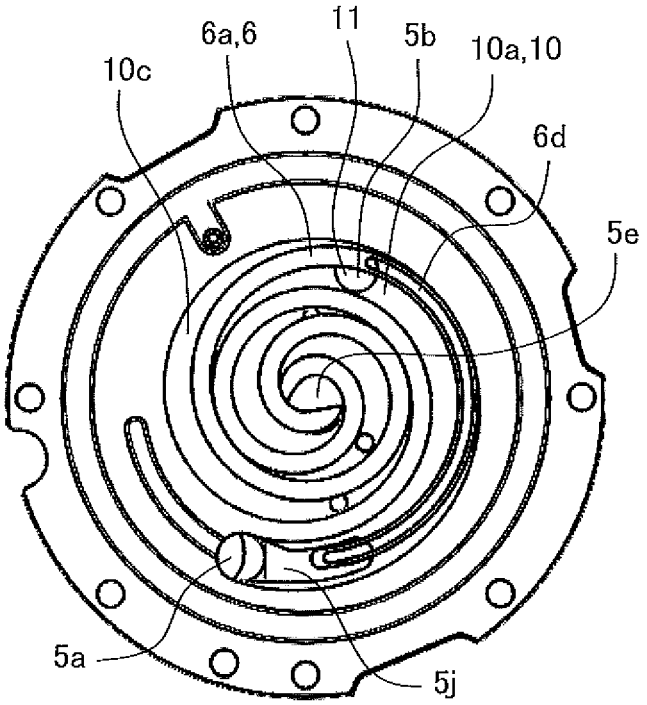
FIG. 7A is a bottom view of the compression chamber and a suction chamber to show a positional relationship between the compression chamber, a bypass port and the tooth-top groove in the compressor according to the first embodiment.

When the revolving scroll 6 is revolved via the eccentric portion 9*b* (see FIG. 2) of the crankshaft 9 driven by the electric motor 4, the refrigerant is flown through the suction pipe 2*d* and the suction port 5*a* into the suction chamber 10*a* (see FIG. 7A).

When the crankshaft 9 proceeds to be rotated, the suction chamber 10*a* is completely surrounded by the lap 5*c* of the fixed scroll 5 and lap 6*a* of the revolving scroll 6, to form the compression chamber 10. The refrigerant is compressed due to the reduction of the volume in the compression chamber 10.

Figure 7B:
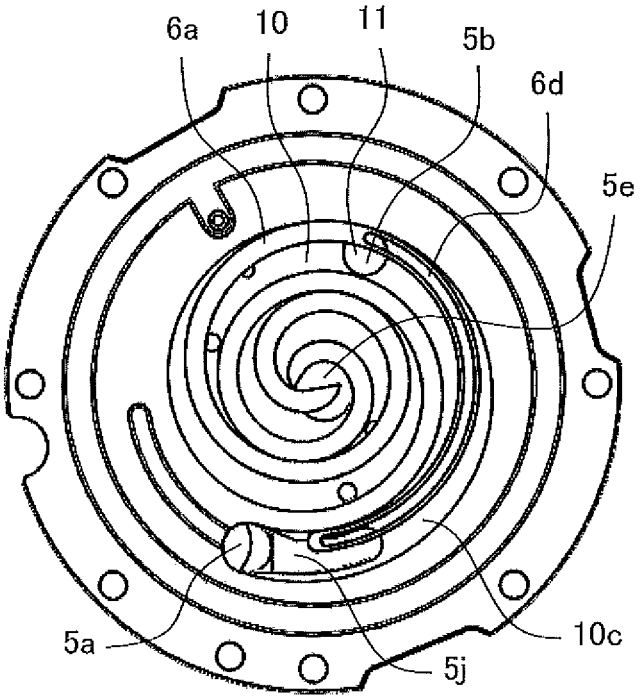
FIG. 7B is a bottom view of the compression chamber and a suction chamber to show a positional relationship between the compression chamber, a bypass port and the tooth-top groove in the compressor according to the first embodiment.

However, at this moment, since the bypass port 5*b* is open, the compression chamber 10 is ideally in communication with the suction chamber 10*c* on an outer side, to bypass the refrigerant in the compression chamber 10 to the suction side, without being compressed. However, as can be seen in FIG. 7B, at this moment, the lap 6*a* of the revolving scroll 6 is in contact with the fixed scroll 5 on the bypass port 5*b*, and the bypass port 5*b* is not directly in communication with the suction chamber 10*c*.

Figure 13:
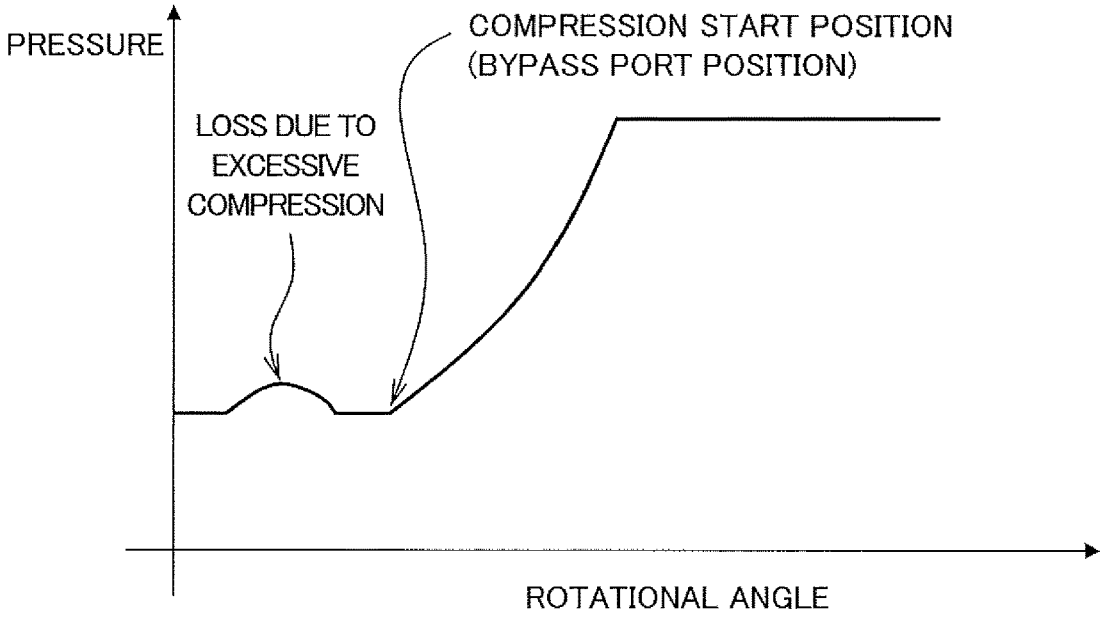
FIG. 13 is a chart showing a relationship between a rotational angle of a conventional second scroll and a pressure in a compressor chamber defined by a first scroll member and the second scroll member.

In this case, a loss due to excessive compression shown in FIG. 13 could occur.

Therefore, tooth-top groove 6*d* described above is formed in the tooth top of the lap 6*a* of the revolving scroll 6 in the compressor 1.

As shown in FIG. 6, the tooth-top groove 6*d* is formed to communicate with the inclined groove 5*j* having the slope communicating with the suction port 5*a* (see FIGS. 7A to 7D), and always communicates between the bypass port 5*b* and the suction side with each other. Therefore, even at the moment shown in FIG. 7B, the refrigerant in the compression chamber 10 is bypassed to the suction side via the bypass port 5*b* and the tooth-top groove 6*d*. Accordingly, the tooth-top groove 6*d*, the inclined groove 5*j* and the suction port 5*a* prevent the refrigerant in the compression chamber 10 from being compressed. The state at that time is shown in FIG. 8. FIG. 8 is a vertical cross-sectional view taken along the center line of the tooth-top groove 6*d*. FIG. 8 shows the bypass port 5*b* in communication with the compression chamber 10 which is not shown in FIG. 8. Arrows al in FIG. 8 indicates the flow of the refrigerant.

As shown in FIG. 8, when the bypass valve 11 moves upward to be away from the upper surface 6*u*1 of the revolving scroll 6, the refrigerant in the compression chamber 10 flows through the gap g1 defined in the bypass port 5*b*, the tooth-top groove 6*d* of the lap 6*a* of the revolving scroll 6, the inclined groove 5*j* and the suction port 5*a* so as to be discharged to the suction side.

Figure 7C:
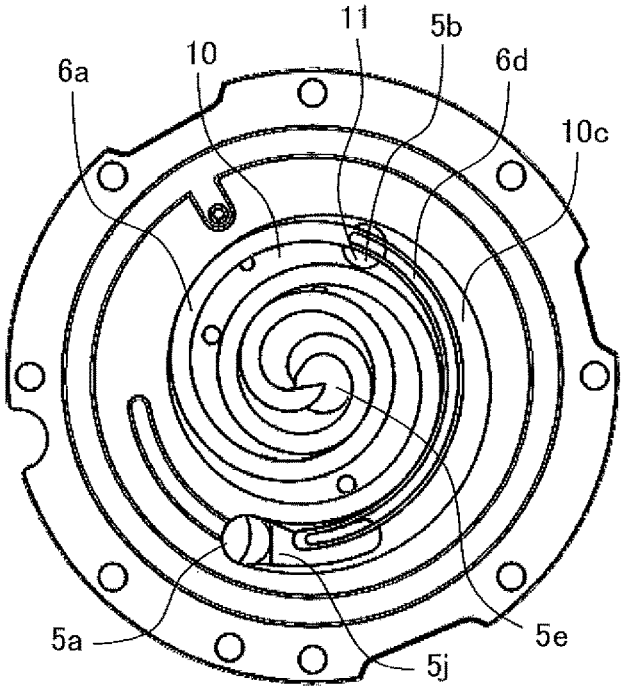
FIG. 7C is a bottom view of the compression chamber and a suction chamber to show a positional relationship between the compression chamber, a bypass port and the tooth-top groove in the compressor according to the first embodiment.

Then, as shown in FIG. 7C, the bypass port 5*b* begins to communicate with the suction chamber 10*c*. The refrigerant in the compression chamber 10 flows out via the two passages: the passage that bypasses the refrigerant from the bypass port 5*b* to the suction chamber 10*c* and the passage that bypasses the refrigerant from the bypass port 5*b* through the tooth-top groove 6*d* to the suction port 5*a* on the suction side (arrows al in FIG. 8).

Figure 7D:
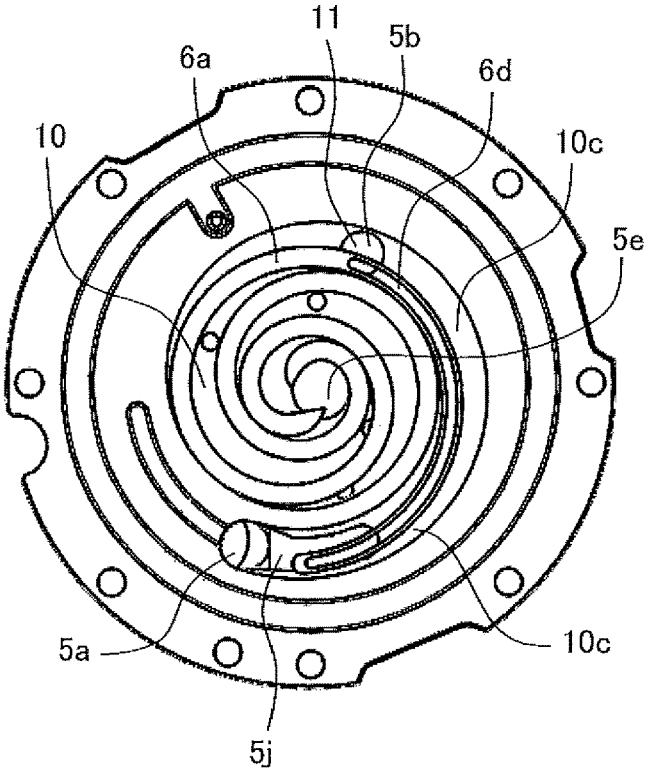
FIG. 7D is a bottom view of the compression chamber and a suction chamber to show a positional relationship between the compression chamber, a bypass port and the tooth-top groove in the compressor according to the first embodiment.

When the rotation angle of the revolving scroll 6 further increases to the state shown in FIG. 7D, the compression chamber 10 is no longer in communication with the bypass port 5*b*. Accordingly, the compression chamber 10 forms the closed space by the lap 5*c* of the fixed scroll 5 and the lap 6*a* of the revolving scroll 6 to start compressing the refrigerant. Then, as in the case of the full load operation, the compressed refrigerant is discharged through the discharge port 5*e* to the discharge pressure chamber 2*f* and flows outside through the discharge pipe 2*e*.

In the partial load operation, as described above, the volume in the compression chamber 10 at the time of starting compression shown in FIG. 7C is smaller than that at the time of starting compression in the full load operation (see FIG. 7B). Therefore, the amount of compressed refrigerant to be discharged is reduced in the partial load operation, and an operation at lower load is executed, without the rotational speed being changed. Note that FIG. 7A to FIG. 7D illustrate the behaviors of the full load operation and the partial load operation in the compression chamber 10 on the inner side of the lap 6*a* of the revolving scroll 6, but exactly the same behaviors hold true in the compression chamber 10 on the outer side of the lap 6*a*.

As described above, the high efficient compressor 1 over a wide operation range is provided, without generating a loss due to excessive compression, by using an appropriate rotational speed according to the state of the mechanical volume control.

<Second Embodiment>

Figure 9:
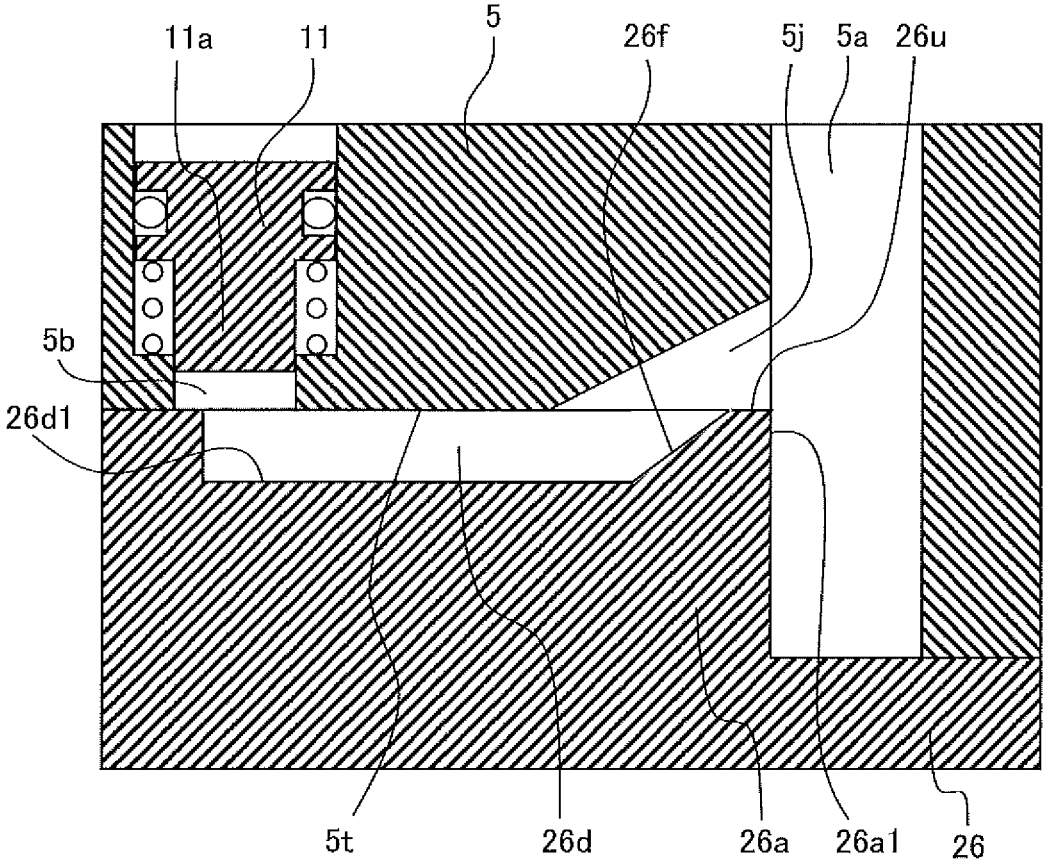
FIG. 9 is a vertical cross-sectional view of a fixed scroll and a revolving scroll along a center line of a tooth-top groove in a compressor according to a second embodiment.

FIG. 9 is a vertical cross-sectional view of a fixed scroll 5 and a revolving scroll 26 along a center line of a tooth-top groove 26*d* in a compressor 1 according to a second embodiment.

The compressor 1 according to the second embodiment is different from the compressor 1 according to the first embodiment in that an inclined portion 26*f* is formed at a lap winding end 26*a*1 of a tooth-top groove 26*d* of the revolving scroll 26.

The inclined portion 26*f* is formed to face the inclined groove 5*j* of the fixed scroll 5. As described above, the inclined groove 5*j* is inclined upward from the tooth-top surface 5*t* of the fixed scroll 5, to communicate between the tooth-top groove 26*d* and the suction port 5*a*.

The inclined portion 26*f* is formed to continuously incline from the end of a bottom surface 26*d*1 of the tooth-top groove 26*d* to an upper surface 26*u* of the revolving scroll 26. The inclined portion 26*f* is formed to incline outward and upward from the bottom surface 26*d*1 in the direction along the inclined groove 5*j* of the fixed scroll 5.

Ideally, the tooth-top groove 26*d* of the revolving scroll 26 does not communicate with other spaces during the full load operation, but, in fact, the lubricant 16 is assumed to flow through a small gap between the tooth-top surface 5*t* of the fixed scroll 5 and the upper surface 26*u* of the revolving scroll 26 to be accumulated in the tooth-top groove 26*d*. In this case, if a wall stands upward from the the bottom of the tooth-top groove 6*d* at a right angle at the winding end 6*a*1 of the lap 6*a* of the revolving scroll 2 as shown in FIG. 8, the lubricant 16 may not be completely discharged from the tooth-top groove 6*d* and may remain therein even if the bypass valve 11 is opened to flow the refrigerant in the tooth-top groove 6*d*. In this case, the passage volume for the refrigerant is reduced in the tooth-top groove 6*d*, to cause a pressure loss.

As shown in FIG. 9, the tooth-top groove 26*d* in the second embodiment includes the inclined portion 26*f* in the tooth-top groove 26*d* at the winding end 26*a*1 of the lap 26*a* of the revolving scroll 26. This smoothly guides the lubricant 16 in the tooth-top groove 26*d* outside so as to be discharged. Consequently, a flow resistance of the refrigerant is prevented from increasing unnecessarily. Therefore, the more efficient compressor 1 is obtained in the partial load operation.

<Third Embodiment>

Figure 10:
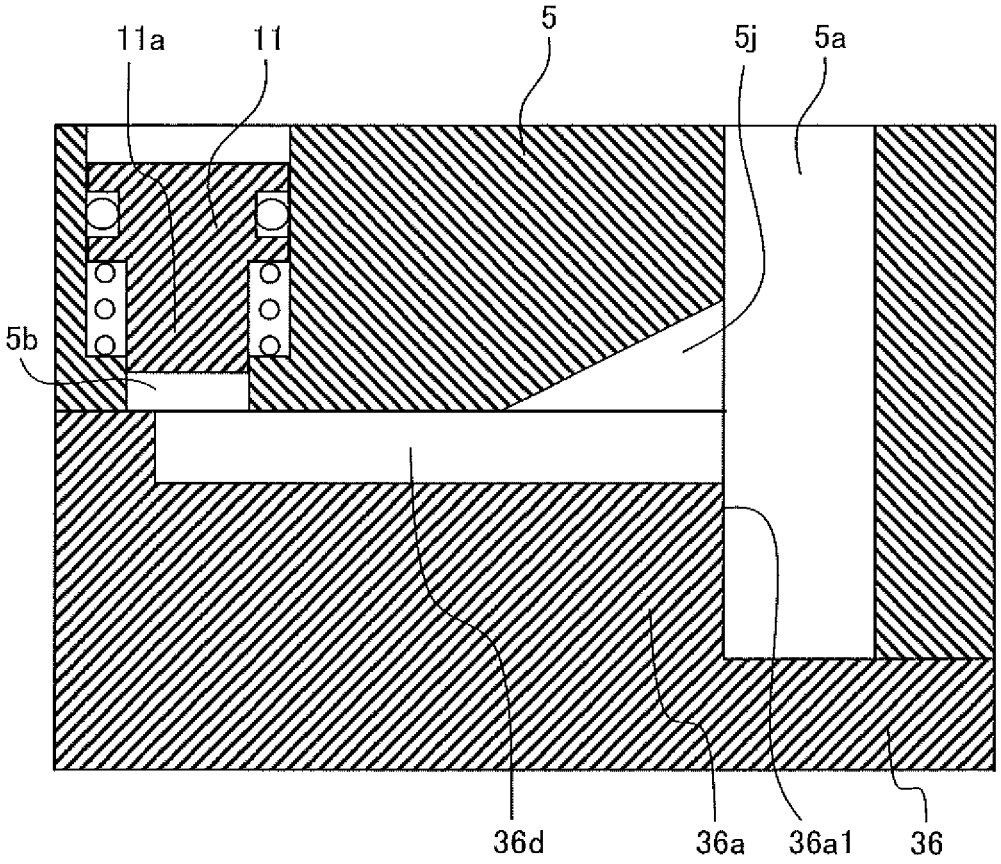
FIG. 10 is a vertical cross-sectional view of a fixed scroll and a revolving scroll along a center line of a tooth-top groove in a compressor according to a third embodiment.

FIG. 10 is a vertical cross-sectional view of a fixed scroll 5 and a revolving scroll 36 taken along a center line of a tooth-top groove 36*d* in the compressor 1 according to the third Embodiment.

The compressor 1 according to the third embodiment is different from the compressor 1 according to the first embodiment in that the tooth-top groove 36*d* at a winding end 36*a*1 of the lap 36*a* of the revolving scroll 36 directly extends to the suction port 5*a* of the fixed scroll 5.

This allows the lubricant 16 to flow outside and prevents it from being accumulated in the tooth-top groove 36*d*. Thus, the more efficient compressor 1 is obtained in the partial load operation.

<Fourth Embodiment>

Figure 11:
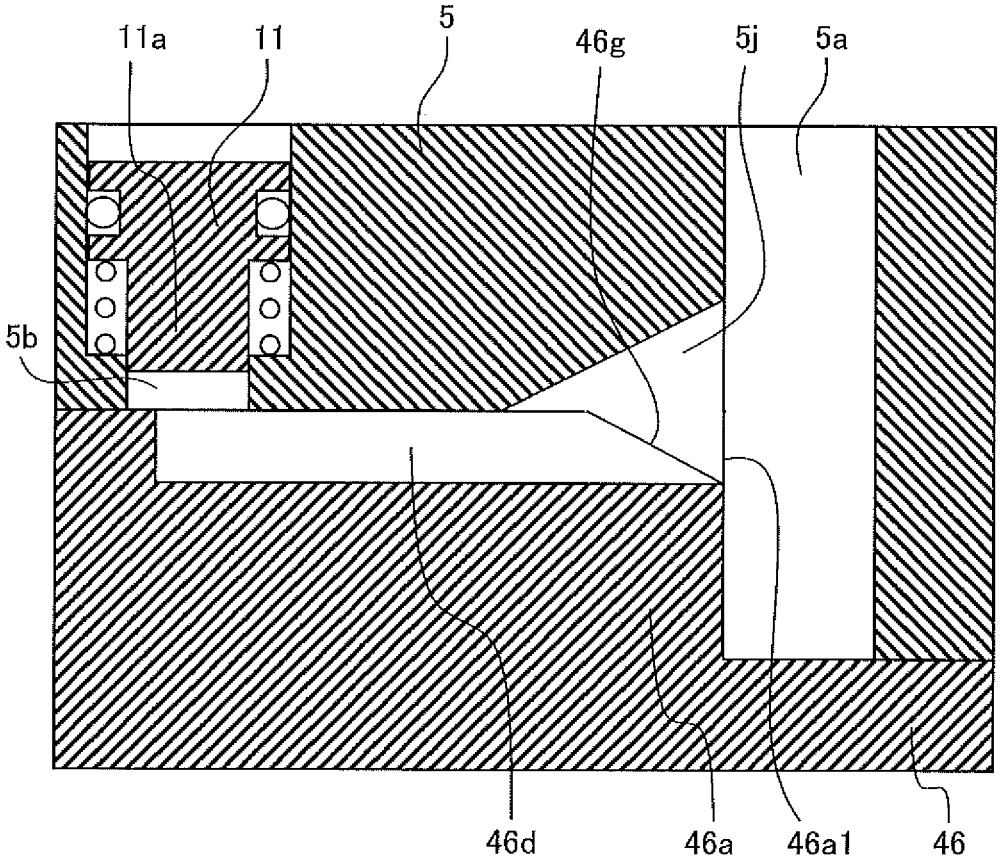
FIG. 11 is a vertical cross-sectional view of a fixed scroll and a revolving scroll along a center line of a tooth-top groove in a compressor according to a fourth embodiment.

FIG. 11 is a vertical cross-sectional view of the fixed scroll 5 and a revolving scroll 46 taken along a center line of a tooth-top groove 46*d* in the compressor 1 according to the fourth Embodiment.

The compressor 1 according to the fourth embodiment is different from the compressor 1 according to the third embodiment in that the tooth top at a winding end 46*a*1 of a lap 46*a* of the revolving scroll 46 is inclined as an inclined portion 46*g* so as to reduce in height as it extends outward in a longitudinal direction of the lap 46*a*.

The inclined portion 46*g* is formed in an arbitrary range on a side closer to the winding end 46*a*1 of the lap 46*a* of the revolving scroll 46. For example, the inclined portion 46*g* may be formed in a portion or in all over a portion on the side closer to the winding end 46*a*1.

This prevents the tooth top at the winding end 46*a*1 of the lap 46*a* from being damaged by stress concentrated thereto. Further, the inclined portion 46*g* promotes the lubricant 16 flowing outside the tooth-top groove 46*d*, and prevents the lubricant 16 from being accumulated in the tooth-top groove 46*d*. Therefore, the more efficient compressor 1 is obtained in the partial load operation.

<Fifth Embodiment>

Figure 12:
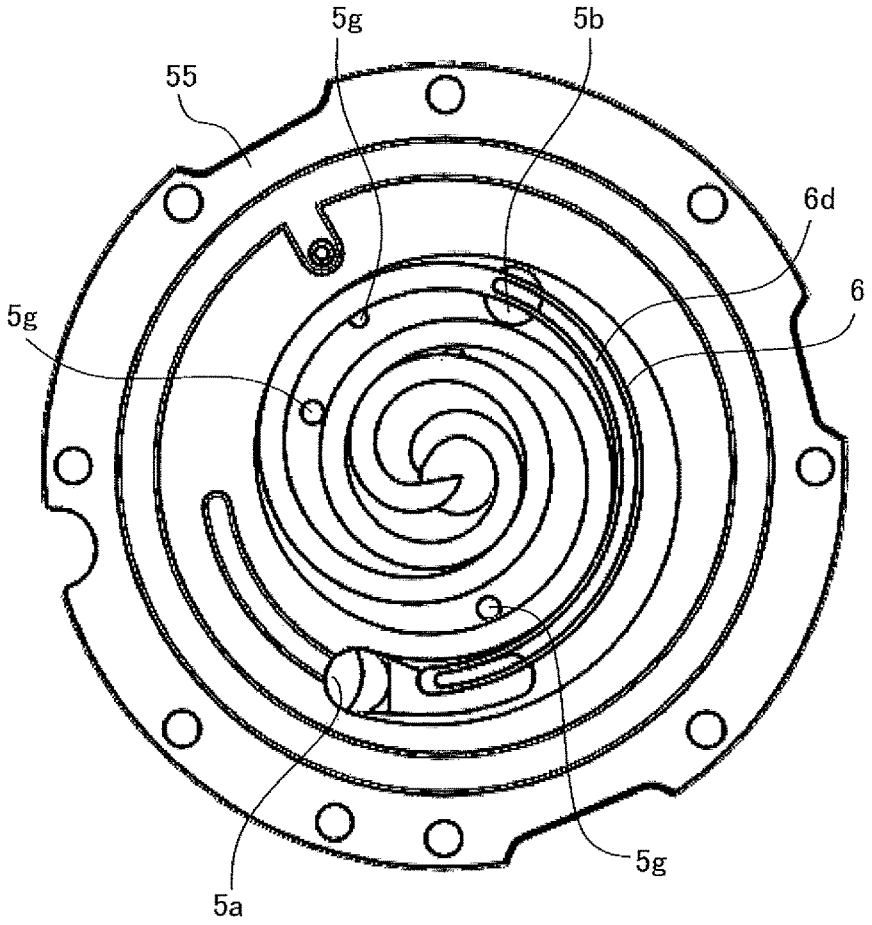
FIG. 12 is a bottom view of a fixed scroll and a revolving scroll in horizontal cross section in the compressor according to a fifth embodiment.

FIG. 12 is a bottom view of a fixed scroll 55 and the revolving scroll 6 in horizontal cross section in the compressor 1 according to a fifth embodiment.

The compressor according to the fifth embodiment has oil inlet holes 5*g* in the fixed scroll 55 that are formed downstream of the tooth-top groove 6*d* of the revolving scroll 6.

If the lubricant 16 is accumulated in the tooth-top groove 6*d* of the revolving scroll 6, the flow resistance of the refrigerant flowing along the tooth-top groove 6*d* is increased, to disturb the flow of the refrigerant in the tooth-top groove 6*d*. Therefore, the refrigerant in the tooth-top groove 6*d* flows less from the compression chamber 10 to the suction side. Thus, a bypass effect is decreased and an excessive compression loss is increased.

In the fifth embodiment, the oil inlet holes 5*g* are formed downstream of the tooth-top groove 6*d* of the revolving scroll 6 so that the lubricant 16 does not flow into the tooth-top groove 6*d* of the revolving scroll 6. Since the refrigerant flows downstream from the suction port 5*a*, the lubricant 16 from the oil inlet holes 5*g* flow downstream. Thus, since the oil inlet holes 5*g* are formed downstream of the tooth-top groove 6*d* of the revolving scroll 6, the lubricant 16 is prevented from flowing into the tooth-top groove 6*d* located upstream of the oil inlet holes 5*g*.

Accordingly, since the lubricant 16 supplied from the oil inlet holes 5*g* flow toward the discharge side (vortex center of the spiral lap 6*a* of the revolving scroll 6), the lubricant 16 is less likely to accumulate in the tooth-top groove 6*d*.

Accordingly, the bypass effect of tooth-top groove 6*d* of the revolving scroll 6 is sufficiently exhibited at the time of partial load operation, and an excessive compression loss is more reliably reduced.

The above embodiments 1 to 5 are described in various configurations, but the structures in the embodiments 1 to 5 may be selectively combined appropriately.

Further, the embodiments 1 to 5 are merely examples of the present invention, and various modified embodiments and feasible embodiments may be available within the scope of the appended claims.

DESCRIPTION OF REFERENCE NUMERALS

1: compressor (scroll compressor)
2: sealed vessel
4: electric motor
5, 55: fixed scroll
5*a*: suction port
5*b*: bypass port (bypass mechanism)
5*c*: lap (fixed lap)
5*g*, 5*h*: oil inlet hole
5*j*: inclined groove (communication groove)
6, 26, 36, 46: revolving scroll
6*a*, 26*a*, 36*a*, 46*a*: lap (revolving lap)
6*d*, 26*d*, 36*d*, 46*d*: tooth-top groove (groove)
10: compression chamber
10*a*: suction chamber
11: bypass valve (bypass mechanism)
26*a*1, 36*a*1, 46*a*1: winding end
26*d*1: bottom surface
26*f*: inclined portion (inclined bottom surface)
46*g*: inclined portion (tooth top on a side closer to the winding end to be reduced in height toward outside)

What is claimed is:

1. A scroll compressor comprising:
a revolving scroll having a revolving lap;
a fixed scroll having a fixed lap;
a compression chamber that is a closed space defined by the revolving scroll and the fixed scroll to compress a working fluid;
a suction chamber that is an open space defined by the revolving scroll and the fixed scroll to suck the compressed working fluid;
an electric motor that drives the revolving scroll;
a bypass mechanism that communicates or shuts off between the compression chamber and the suction chamber; and
a sealed vessel that accommodates the revolving scroll, the fixed scroll, the compression chamber, the suction chamber, the electric motor and the bypass mechanism,
wherein the bypass mechanism has:
a bypass port that is formed in the fixed scroll and is capable of communicating between the compression chamber and the suction chamber; and
a bypass valve that is capable of opening and closing the bypass port, and
wherein a groove is formed in the revolving lap to communicate between the bypass port and a suction pressure space when the bypass port is open and
the groove has a bottom surface, which is inclined outward and upward, at an end closer to a winding end of the revolving lap of the revolving scroll.

2. The scroll compressor according to claim 1,
wherein the groove is a tooth-top groove in a concave shape.

3. The scroll compressor according to claim 1,
the fixed scroll has a suction port through which the working fluid is sucked into the suction chamber, and
a communication groove having a shape to communicate between the groove and the suction port on a lower surface of the fixed scroll.

4. The scroll compressor according to claim 1,
the fixed scroll has a suction port through which the working fluid is sucked into the suction chamber; and
the groove is formed to extend to the suction port.

5. The scroll compressor according to claim 1,
wherein the revolving scroll has a tooth top, that is formed to reduce in height as it extends outward in a longitudinal direction of the revolving lap, at a winding end of the revolving lap.

6. The scroll compressor according to claim 1,
an oil inlet hole is formed in the fixed scroll through which an oil is supplied, and
the oil inlet hole is formed more downstream than an end at a downstream of the groove with respect to a flow of the working fluid.

* * * * *